US005185044A

United States Patent [19]

Verhoeven et al.

[11] Patent Number: 5,185,044

[45] Date of Patent: Feb. 9, 1993

[54] METHOD OF MAKING "DAMASCUS" BLADES

[76] Inventors: John D. Verhoeven, 2111 Graeber, Ames, Iowa 50010; Alfred H. Pendray, Rte. 2, Box 1950, Williston, Fla. 32696

[21] Appl. No.: 827,401

[22] Filed: Jan. 29, 1992

[51] Int. Cl.[5] ..... C21D 9/42; C21D 8/00

[52] U.S. Cl. ..... 148/546; 148/540; 148/543; 148/544

[58] Field of Search ..... 148/540, 543, 544, 546

[56] References Cited

U.S. PATENT DOCUMENTS 4,399,611 8/1983 Maringer ..... 428/678
4,881,430 11/1989 Hubbard ..... 29/424

OTHER PUBLICATIONS

J. Wadsworth and Oleg D. Sherby, "On the Bulat-Damascus Steels Revisited", Prog. Mat. Sci., vol. 25, pp. 35-56 (1980) Great Britain.

N. Belaiew, "Damascene Steel", Journal Iron Steel Institute, vol. 97, pp. 417-439 (1918).

Zschokke, "Du Dammasse et des Lames de Damas", Rev. Met., vol. 21, pp. 635-669 (1924).

Carlo Panseri, "L'aciaio di Damasco nelle leggenda e nella realta", Armi Antiche, vol. 3, p. 3 (1962).

Smith, "A History of Metallography", pp. 14-39, Univ. of Chicago Press, Chicago.

Piaskowski, "Metallographic Examination of Two Damascene Steel Blades", J. Kist. Arabic Sci., vol. 2, pp. 2-30 (1978).

D. T. Peterson, H. H. Baker and J. D. Verhoeven, "Damascus Steel, Characterization of One Damascus Steel Sword", vol. 24, pp. 355-374 (1990).

Leo S. Fieiel, "On Damascus Steel", Atlantis Arts Press, (1991), Atlantis, Fla.

*Primary Examiner*—Deborah Yee

*Attorney, Agent, or Firm*—Flynn, Thiel, Boutell & Tanis

[57] ABSTRACT

A method of making a steel article having a "Damascus" surface pattern wherein a steel melt comprising about 1.0 to about 2.0 weight % carbon is solidified to form an ingot, the ingot is heated between about 1100° to about 1299° C. for a time at temperature of about 5 to about 12 hours, a malleable envelope is formed about the ingot separately or concurrently with the heat treatment, and the enveloped ingot is shaped (e.g., forged) initially at an ingot temperature above the $A_{r\text{-}gr}$ temperature but below the liquidus temperature and then at an ingot temperature below the $A_{cm}$ temperature. The envelope is then removed from the shaped ingot.

13 Claims, 4 Drawing Sheets

METHOD OF MAKING "DAMASCUS" BLADES

FIELD OF THE INVENTION

The present invention relates to a method of making a steel article having an external surface appearance and an internal microstructure resembling that present on an antique "Damascus" steel sword or blade.

BACKGROUND OF THE INVENTION

So-called Damascus steel swords were known from around the seventh century onward and dominated warfare for centuries as a result of their good toughness in combination with their outstanding cutting ability. The name derives from the fact that these swords were first encountered by Europeans in Damascus Syria. Damascus steel swords were regarded as a thing of beauty as a result of their unique surface pattern, FIG. 1, and as a thing of mystery as a result of the inability of early Europeans to reproduce the swords despite efforts to this end over the last two centuries.

Damascus steel swords are still regarded in this manner as evidenced by continuing efforts up to the present time to determine the methodology used to produce the swords. For example, the Wadsworth and Sherby article "On the Bulat-Damascus Steel Revisited", Prog. Mat. Sci., Vol 25, P. 35 (1980) reports previous claims by scientists that processing techniques had been discovered for reproducing the surface pattern characterizing the genuine antique Damascus steel blade. However, these previous reports have failed to show blades that embody the surface pattern and internal microstructure of genuine antique Damascus steel blades.

Several technical publications have documented the surface pattern embodied on antique Damascus steel blades; see the aforementioned Wadsworth and Sherby article, the Belaiew article "Damascene Steel", Journal Iron Steel Institute, Vol. 97, p.417 (1918); the Zschokke article "Du Dammasse et des Lames de Damas", Rev. Met., Vol. 21, p.635 (1924); the Panseri article "L'aciaio di Damasco nella leggenda e nella realta", Armi Antiche, Vol. 3, p. 3 (1962); the Smith article "A History of Metallography", Chapters 3–5, Univ. Chicago Press, Chicago, Ill.; the Piaskowski article "Metallographic examination of two damascene steel blades", J. Hist. Arabic Sci., Vol. 2, p. 2 (1978); the Peterson et al article "Damascus Steel, Characterization of One Damascus Steel Sword", Materials Characterization, Vol. 24, p. 255 (1990); and the Figiel article "On Damascus Steel", Atlantis Arts Press, 522 Muirfield Dr., Atlantis, Fla. (1991).

Several of these articles have presented cross-sectional views of the blades which allow the internal blade microstructure to be ascertained. FIG. 2 is a micrograph of a transverse section from the aforementioned Peterson article which illustrates that the blade contains aligned sheets of $Fe_3C$ (a compound commonly called cementite) particles in a matrix of pearlitic iron. The cementite particles are clustered around the centerlines of the sheets (referred to hereafter as cluster sheets). That article also demonstrates that the alignment of the cluster sheets is the same in both the transverse and longitudinal sections of the blade and that a spacing between the cluster sheets in the range of 30 to 100 microns achieves the unique surface pattern evidenced by a genuine antique Damascus steel blade.

An object of the present invention is to provide a method of making a steel article which exhibits the unique surface pattern and internal structure of a genuine antique Damascus steel sword or blade.

SUMMARY OF THE INVENTION

The present invention contemplates a method of making a steel article having a "Damascus" surface pattern wherein a steel melt comprising about 1.0 to about 2.0 weight % carbon is solidified to form an ingot. The ingot must contain some impurity elements such as Mn, Si, S and P at levels of about, 0.02 to 0.4, 0.02 to 0.3, 0.01 to 0.04, 0.03 to 0.15, weight % respectively. The ingot is heated between about 1100° to about 1200° C. for a time at temperature of about 5 to about 12 hours, a malleable envelope is formed about the ingot, and the enveloped ingot is shaped (e.g., forged) initially at an ingot temperature above the $A_{r\text{-}gr}$ temperature (temperature at which graphite first forms on cooling the ingot) but below the liquidus temperature and then at an ingot temperature below the $A_{cm}$ temperature (temperature at which cementite first forms on cooling the ingot). The envelope is then removed from the shaped ingot.

The malleable envelope is formed about the ingot as a result of substantial hot shortness exhibited by the ingot that prevents subsequent shaping of the ingot. The hot shortness is attributable to the presence of a substantial amount of steadite microconstituent (a ternary eutectic including Fe, $Fe_3P$, and $Fe_3C$) in the as-solidified microstructure. The malleable envelope enables shaping (e.g., forging) of the ingot to desired shape without ingot breakage. In one embodiment of the invention, the malleable envelope is formed in-situ on the ingot during the aforementioned heat treatment at 1100° to 1200° C. ingot by heating in an oxidizing atmosphere that forms a decarburized malleable surface case on the ingot. Alternately, the malleable envelope can be formed by depositing a low carbon steel on the ingot; e.g., by depositing a low carbon steel weld bead on the ingot. Moreover, the malleable envelope can be formed by enclosing the ingot in a sealed container of ductile material, such as Cu, Ni, or stainless steel.

In another embodiment of the invention, the initial shaping (e.g., forging) temperature is preferably about 10° to about 300° C. above the $A_{r\text{-}gr}$ temperature but below the liquidus temperature to prevent graphite formation in the microstructure during the shaping operation. A more preferred initial shaping temperature is about 30° to about 100° C. above the $A_{r\text{-}gr}$ temperature. The final shaping temperature is about 50° to about 300° C. below the $A_{cm}$ temperature, more preferably about 100° to about 170° C. below the $A_{cm}$ temperature.

The invention may be better understood when considered in light of the following detailed description thereof which is given hereafter in conjunction with the following drawings.

Figure 5:
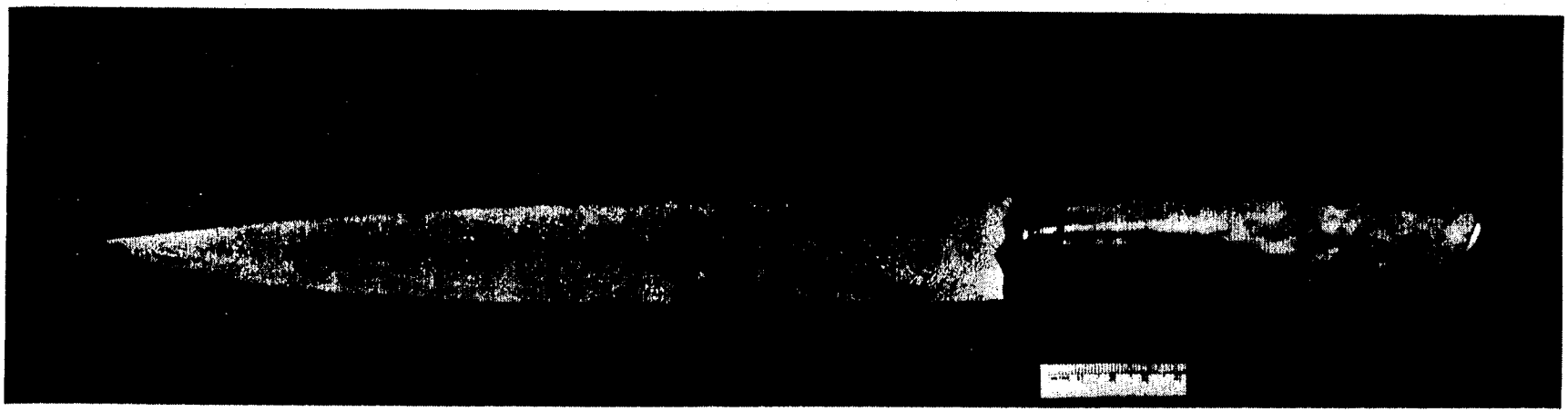
FIG. 5 is a photograph at 0.5X of a knife blade made by the method of the invention.

FIGS. *7a* and *7b* are photomicrographs at 100X of transverse and longitudinal sections, respectively, of the blade of FIG. 5 showing the cluster sheets of cementite particles in a pearlitic matrix.

DETAILED DESCRIPTION OF THE INVENTION

Several steel ingots were solidified from steel melts having compositions simulating the average composition of genuine Damascus steels set forth in the Verhoeven et al article "Damascus Steel, Part II: Origin of the Damask Pattern", Metallography, Vol. 20, p. 153 (1987), the teachings of which are incorporated herein by reference. For example, referring to the Table set forth below, it can be seen that the measured compositions of ingots 11, 12, 13, and 14 of the invention have C and S levels quite similar to the average of the Damascus steels. The P levels of the ingots 11–14 are lower than that of the Damascus steels. The Mn and Si levels of the ingots 11–14 are both slightly higher except for ingot 13 where the Mn is lower.

TABLE 1

| Steel | C | Mn | V | Si | S | P | Cu | Cr | Ni | Mo | Al | Nb |
|---|---|---|---|---|---|---|---|---|---|---|---|---|
| | Measured chemical co$_m$ positions, wt. %. (Spectrographic and combustion analyses) | | | | | | | | | | | |
| Damascus | 1.60 | .056 | — | .043 | .02 | .107 | .044 | trace | .012 | — | — | — |
| 11 (Sorrel + 1010) | 1.70 | .39 | .015 | .16 | .020 | .021 | .025 | .05 | .055 | .005 | .017 | .02 |
| 12 (Sorrel + Wrt. Fe) | 1.66 | .27 | .01 | .14 | .025 | .058 | .042 | .06 | .04 | .01 | .007 | — |
| 13 (Armco + Wrt. Fe) | 1.71 | .04 | — | .22 | .03 | .04 | .04 | .03 | .05 | — | .003 | — |
| 14 (Sorrel + 1010) | 1.64 | .26 | .03 | .17 | .014 | .07 | .02 | .06 | .05 | — | .02 | .02 |

The ingot compositions used in practicing the invention comprise about 1.0 to about 2.0 weight % C, about 0.02 to about 0.4 weight % Mn, about 0.02 to about 0.3 weight % Si, about 0.01 to about 0.04 weight % S, and about 0.03 to about 0.15 weight % P.

The ingots 11–14 were formed by melting appropriate steel charges in clay graphite crucibles having the inside surface thereof coated with a high alumina wash available as Blu-Ram wash from Combustion Engineering Refractories, Valley Forge, Pa. The charge for Ingots 11 and 14 comprised 0.77 kilograms of Sorrel iron, 1.5 kilograms of clean type 1010 steel scrap, and approximately 14 grams of charcoal. The charge was covered with approximately 0.5 cups of oyster shells and 1 cup of broken glass. The oyster shells and glass were used to form a molten slag during the melting operation to protect the charge from oxidation.

The charge for ingot 12 was similar to the charges for ingots 11 and 14 except that wrought (Wrt.) iron was used in lieu of the type 1010 steel and a layer of green leaves was added directly above the charge, and below the oyster shells and glass. The charge for ingot 13 was also similar to the charges used for ingots 11 and 14 with the exception that Armco iron (low carbon iron) plus charcoal was used in lieu of the Sorrel iron.

After charging, the clay graphite crucibles were covered with a snug fitting crucible lid that was sealed thereto by the aforementioned high alumina wash. Each crucible was then lowered into a gas fired furnace preheated to about 1000° C. The furnace was then heated with maximum gas flow for a time of 90 minutes to melt the steel charge. The gas flow was then shut off, and the crucible was allowed to furnace cool to 100°–300° C. before removal from the furnace. The final ingots had a height of approximately 4.3 centimeters, a base diameter of approximately 7.5 centimeters, and an upper diameter of approximately 11 centimeters. The upper surfaces of the ingots were flat (exhibited no shrinkage cavity), and long radially oriented dendrites were observed on these upper ingot surfaces. The slag formed during the melting operation maintained the upper surface of the ingots a bright metallic color.

The as-solidified ingots 11–14 included a substantial amount (e.g., 0.5 volume %) of steadite microconstituent upon solidification. The steadite microconstituent is a ternary eutectic comprising the 3 phases, Fe, $Fe_3P$, and $Fe_3C$, and has a melting point of about 950° C. The presence of substantial amounts of this steadite microconstituent was found to impart significant hot shortness to the ingots 11–14. Hot shortness refers to brittleness and breakup of the ingots when heated to an elevated forging temperature and forged In particular, the steadite microconstituent has been found to melt at forging temperatures above 950° C. and wet the grain boundaries during the forging operation, resulting in the observed brittle/breakup behavior of the ingots.

In accordance with one embodiment of the invention, the ingots 11–14 were subjected to a heat treatment in an oxidizing environment effective to form a decarburized malleable surface case or rim thereon of sufficient thickness to enable subsequent shaping (e.g., forging) of the ingots without breakup. In particular, the ingots 11–14 were packed in iron oxide and sealed inside mated clay graphite crucible halves coated on the interior with the aforementioned high alumina wash and heated in air in a furnace to about 1100° to about 1200° C. for times which varied between 10 to 11 hours. The ingots were furnace cooled and sectioned metallographically. The oxidizing heat treatment was found to produce a decarburized surface case or rim of 4–5 millimeters thickness which contained no S or P compounds.

In effect, the heat treatment produced a surface case or rim of substantially pure malleable, soft iron about the outside of the ingot. The surface case or rim was adequately ductile and sufficiently thick (e.g., generally from 1 to 20 millimeters, preferably 2 to 6 millimeters) to act as a malleable envelope to permit forging without ingot breakup, despite the presence of the hot short interior of the ingots. The presence of the hot short ingot interior was confirmed by grinding the decarburized surface case off one side of an ingot and attempting to forge the ground ingot. The ground ingot broke on forging at the ground off region, and there was evidence that liquid came out from the ingot interior at the ground region.

Not only does the aforementioned heat treatment form the desired malleable surface envelope on the ingots but also the heat treatment is effective to form distinct sheets of cementite ($Fe_3C$) in the pearlitic matrix (see FIGS. 5,6) at an intersheet spacing (e.g., about 50 microns) that is large enough to provide the desired visible Damascus surface pattern on the forged ingot. Generally, the heat treatment is conducted at about 1100° to 1200° C. for a time at temperature of about 5 to about 12 hours. Preferably, the temperature is about 1140° to about 1160° C. for a time of about 9 to about 12 hours. Experiments have shown that the function of the heat treatment is to remove the microsegregation between secondary dendrite arms but not the primary dendrite arms. This is believed to produce a larger spacing of the microsegregation which presumably causes nucleation of the $Fe_3C$ cluster sheets in the pearlitic matrix. The ingots are cooled at a moderate rate from the heat treatment temperature. The ingots should not be quenched in water or oil. However, the cooling rate cannot be too slow because the microsegregation will be decreased too much by diffusion processes. The ingot temperature should drop from the liquidus temperature to 200° C. below that temperature in about 30 to about 60 minutes.

The heat treatment may be conducted in a cyclic manner wherein the ingot is heated to the heat treatment temperature, held at the temperature for a shorter time (e.g., 0.5 to 2 hours, preferably 0.75 to 1.25 hours) and then cooled to room temperature, and the cycle repeated until the accumulated time at the heat treatment temperature is in the range of about 5 to about 12 hours. As will be discussed below, the formation of the malleable surface envelope about the ingot and the heat treatment may be effected in separate steps (instead of concurrently in one step) in accordance with other embodiments of the invention.

For example, in accordance with another embodiment of the invention, the malleable envelope can be formed about the as-cast ingot by covering the ingot with a low carbon steel by, for example, running (depositing) a weld bead of low carbon steel (type 1010 steel) over the ingot surface. The low carbon weld bead deposited on the ingot was found to permit subsequent forging of the as-cast hot short ingot without ingot breakage. However, this weld bead depositing treatment was not effective to yield the desired Damascus surface pattern on the forged ingot. It was necessary to heat treat the ingots at about 1100° to about 1200° C. as described above for 5–12 hours to yield the desired surface pattern on the forged ingot. The heat treatment may be conducted before or after the weld bead envelope is applied to the surface of the ingot. Heat treatment after the weld bead is deposited is preferred.

In accordance with still another embodiment of the invention, the as-cast ingot is subjected to heat treatment at 1100° to 1200° C. for 5 to 12 hours to develop the desired $Fe_3C$ cluster sheet spacing and then in a subsequent step is placed in a removable, ductile container which is welded shut (sealed) about the ingot. The container may comprise any ductile material, such as Cu, Ni, or stainless steel that is compatible with the steel ingot therein during the forging operation.

Figure 4:
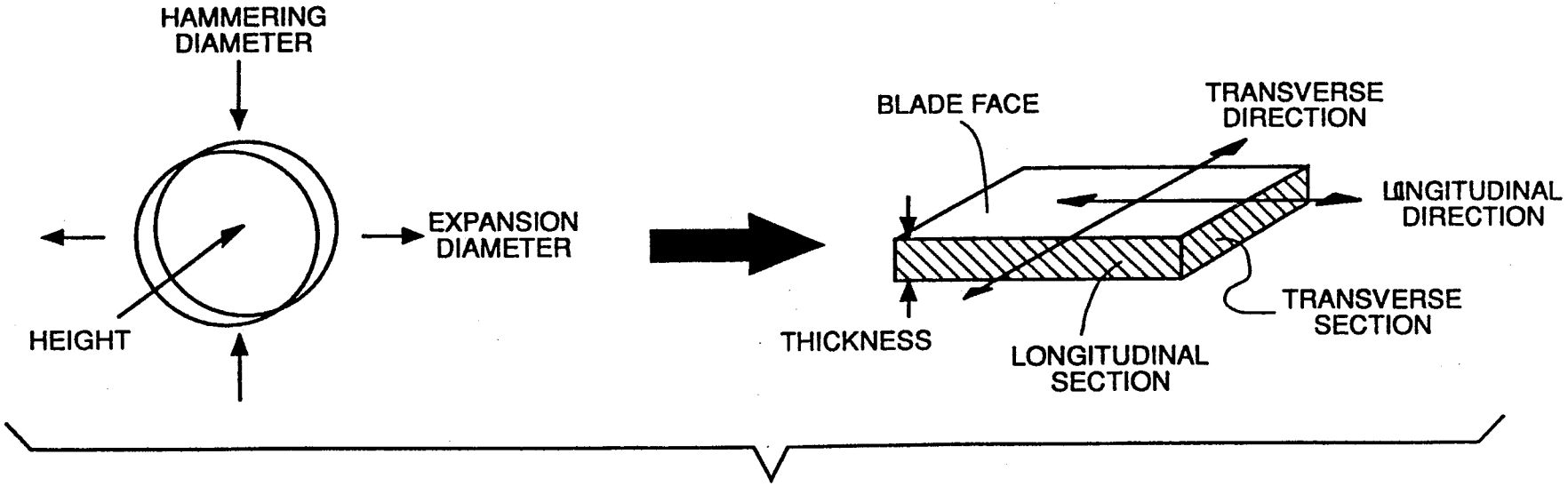
FIG. 4 is a schematic view illustrating the forging directions relative to the cast and forged ingot.

After the ingots 11–14 were heat treated and the malleable envelope formed as described above for the various embodiments of the invention, they were subjected to multiple forging operations using a forging hammer to form the blade shape shown in FIG. 5. Essentially flat hammer head shapes were used, and the shaping of workpiece is controlled by lateral and rotary motion of the workpiece relative to the hammer head. Heating of the ingots 11–14 was conducted in a gas fired furnace which produced a reducing atmosphere for preventing oxidation of the ingots. The ingot shape change on forging is illustrated in FIG. 4. The diametrical direction of the original ingot along which the hammer acted is present in the final blade shape as the direction perpendicular to the blade face (i.e., the thickness direction). The transverse direction of the forged blade was the height direction (bottom to top) of the original ingot. The longitudinal direction of the forged blade was the diametrical direction of the ingot at right angles to the hammering diameter. With this shape change, virtually all of the net metal flow occurred in the longitudinal direction of the forged blade with a near zero net flow in the transverse direction of the blade.

Ingot 11 was forged to a blade shape using 70 forge cycles. A forge cycle consists of heating the ingot in the gas furnace to some temperature, removing it from the furnace and repeatedly striking it with the forging hammer as the piece is suitably translated and rotated between the forging hammer faces to achieve the desired shape change. The hammering continues as the temperature falls to some minimum value, whereupon the ingot is returned to the furnace. In all of the cycles employed, this minimum temperature was 680° to 700° C. In the initial 44 forging cycles of ingot 11, the ingot was removed from the furnace after heating to a temperature in the range of 1100° to 1200° C. as measured by a thermocouple in the furnace. In the final 36 forging cycles the temperature was lowered to 1000° C. In these final 36 cycles, all of the forging deformation was conducted at temperatures below the $A_{cm}$ temperature ($A_{cm}$=1045° C. for ingot 11 and is the temperature where cementite first forms on slow cooling the ingot composition involved.)

Ingot 12 was forged to a blade shape using 38 forge cycles. In the initial 20 forging cycles of ingot 12, the ingot was removed from the furnace after heating to a temperature in the range of 1000°±30° C. as measured by an infrared pyrometer focused on the ingot In the final 18 forge cycles, the temperature of the ingot upon removal from the furnace was lowered to 970°±20° C. for the first 6 cycles and 920°±25° C. for the final 12 cycles.

The forging of ingots 11 and 12 established that optimum Damascus surface patterns on the forged blades were effected when the final forging temperature upon removal from the furnace (during the last 10–30 forging cycles) was about 140° C. below the $A_{cm}$ temperature. Subsequent experiments have shown that the number of final forging cycles may be extended well above 30. Final forging temperatures of about 80° C. below the $A_{cm}$ temperature produced Damascus surface patterns but of inferior quality to those produced at 140° C. below the $A_{cm}$ temperature. Moreover, the forging of ingots 11 and 12 established that a competing reaction of graphite formation was occurring during the forging operation. For example, the final forged blades contained not only spaced apart $Fe_3C$ cluster sheets but also parallel lying sheets of graphite. These graphite sheets adversely affected the quality of the Damascus pattern achieved on the forged blades.

The formation of graphite during the forging of ingot 13 was prevented by changing the temperature range of the initial forging cycles such that the lowest temperature of the hammering was raised from the previous 680°-700° C. range to above the $A_{r\text{-}gr}$ temperature ($A_{r\text{-}gr}$=1000° C. for ingot 14 and is the temperature at which graphite first forms on cooling). Forging at above the $A_{r\text{-}gr}$ temperature was found to be effective in preventing graphite formation during both the initial forging cycles and the subsequent forging cycles.

The initial 6 forging cycles for ingot 13 were conducted with the ingot temperature falling from 1175° to 1025° C. A total of 87 subsequent forging cycles were then employed. In the first 47 cycles the ingot temperature fell from 1000° C. to the 680°-700° C. range, in the next 20 cycles it fell from 900° C. to the 680°-700° C. range, and in the final 20 cycles it fell from 825° C. to the 680°-700° C. range.

Figure 1:
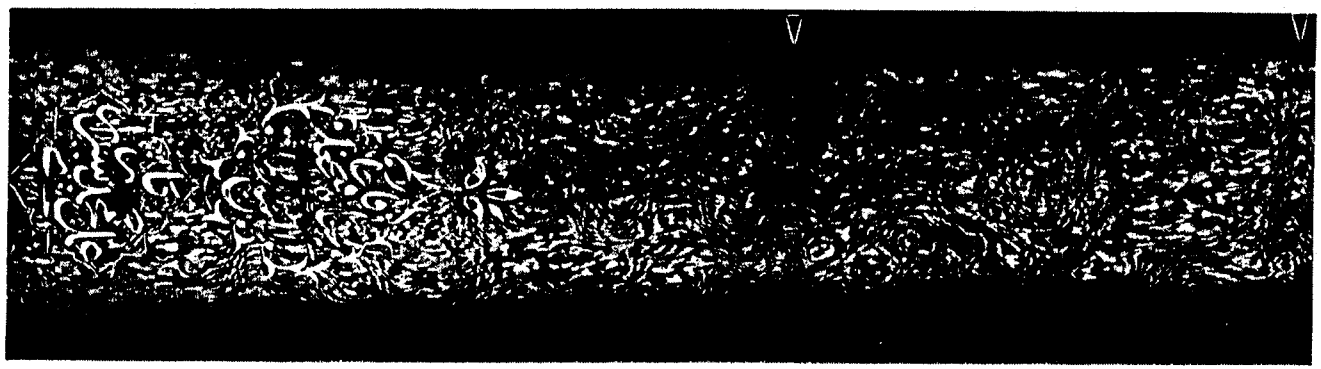
FIG. 1 is a photograph at 1X of an antique Damascus steel blade from the collection of the aforementioned Figiel article.
Figure 2:
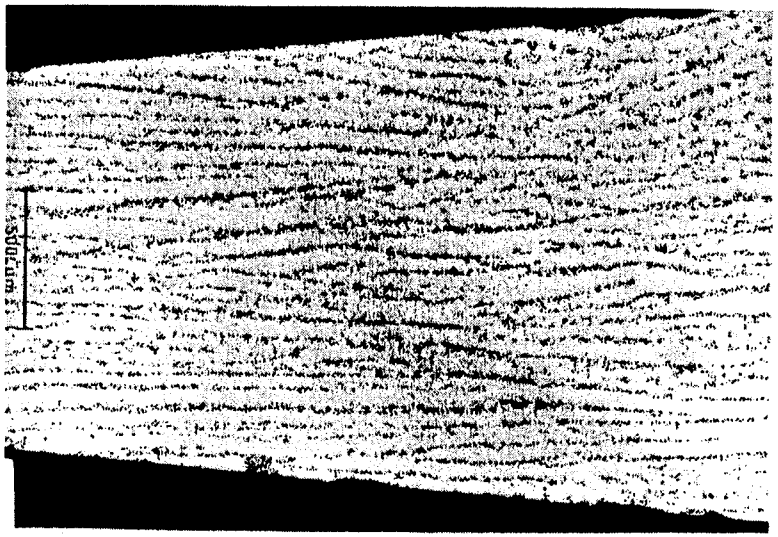
FIG. 2 is a transverse section of a genuine Damascus steel blade analyzed in the aforementioned Peterson at al article.
Figure 3:
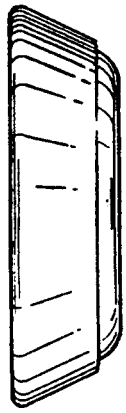
FIG. 3 is an elevational view of an ingot of the invention.
Figure 6:
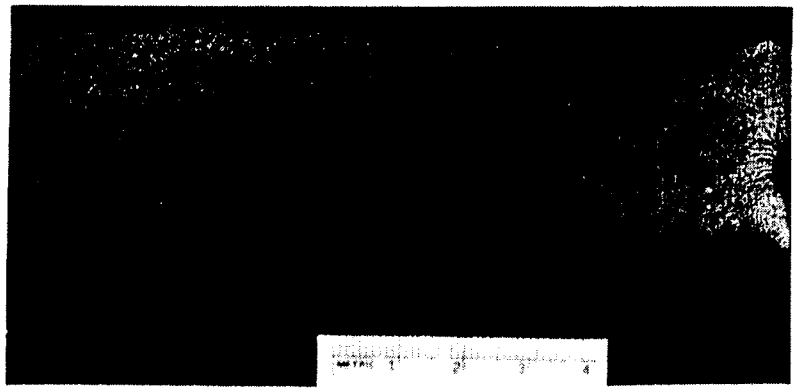
FIG. 6 is an enlarged view at 0.9X of the knife blade of FIG. 5 showing the surface pattern on the blade.
Figure 7A:
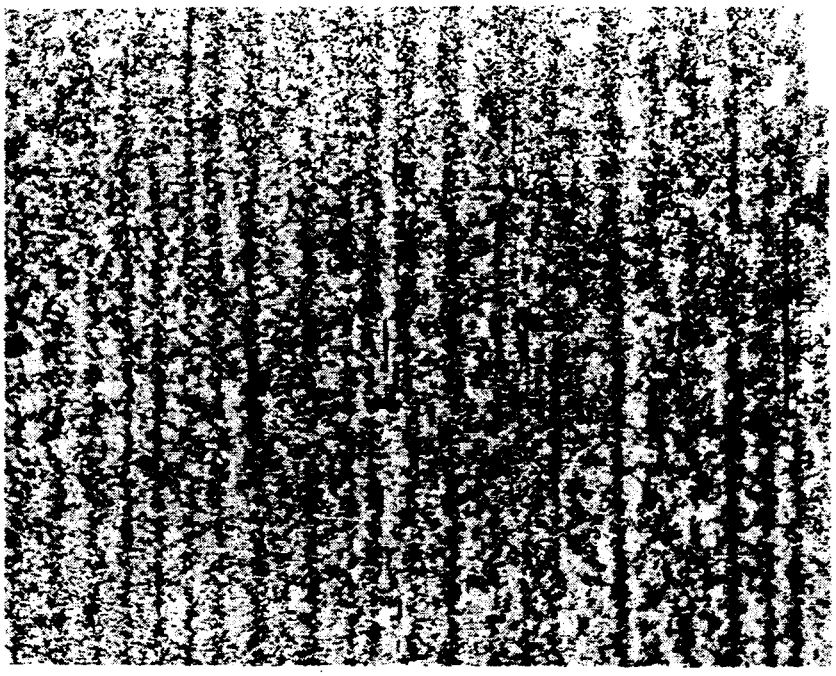
Figure 7B:
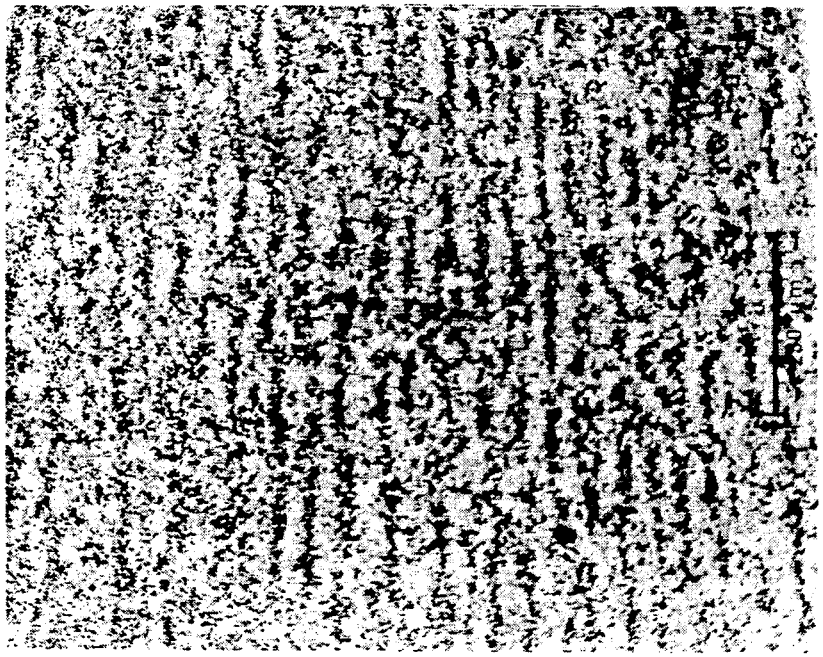

FIGS. 5 and 6 show the surface pattern achieved on the blade forged from an ingot made in the same manner as ingots 11 and 14 (after the decarburized surface case was removed). The close resemblance to the surface pattern of the genuine Damascus blade in FIG. 1 is apparent. FIGS. *7a* and *7b* illustrate the microstructure in transverse and longitudinal sections of the blade forged from ingot 14 as including aligned sheets (cluster sheets) of cementite in a pearlitic matrix with the sheets spaced apart by about 50 to about 60 microns.

In general, the initial forging cycles should be conducted at an ingot temperature which does not fall below about 10° to about 300° C. above the $A_{r\text{-}gr}$ temperature but not to exceed the liquidus temperature. Preferably, the initial forging steps are conducted at an ingot temperature of about 30° to about 100° C. above $A_{r\text{-}gr}$. The final forging cycles are generally conducted at an initial ingot temperature of about 50° to about 300° C. below the $A_{cm}$ temperature. Preferably, the final forging cycles are conducted at an initial ingot temperature of about 100 to about 170° C. below the $A_{cm}$ temperature.

Although the ingots 11-14 were subjected to a forging operation in order to form the blade shape shown, the invention is not so limited and may be practiced using other mechanical deformation processing, such as hot rolling, to achieve the final forged article shape. Hot rolling may be especially useful for shaping larger size ingots which may be 10 to 20 tons in weight if desired.

After forging to the final article shape desired, the malleable envelope is removed. For example, the decarburized surface case was removed from the forged ingots by mechanical grinding or machining. The weld bead envelope and the ingot container referred to above can also be removed by mechanical grinding or machining.

While the invention has been described in terms of specific embodiments thereof, it is not intended to be limited thereto but rather only to the extent set forth hereafter in the claims which follow.

We claim:

1. A method of making a steel article having a "Damascus" surface pattern and an internal "Damascus" microstructure, comprising the steps of:

a) solidifying a steel melt comprising about 1.0 to about 2.0 weight % carbon, about 0.02 to about 0.4 weight % Mn, about 0.02 to about 0.3 weight % Si, about 0.01 to about 0.04 weight % S and about 0.03 to about 0.15 weight % P, to form an ingot, b) heating the ingot between about 1100° to about 1200° C. for a time at temperature of about 5 to about 12 hours, c) forming a malleable envelope about the ingot, d) shaping the enveloped ingot initially at an ingot temperature above the $A_{r\text{-}gr}$ temperature but below the liquidus temperature and then at an ingot temperature below the $A_{cm}$ temperature, and e) removing the envelope from the shaped ingot.

2. The method of claim 1 wherein the ingot as cast includes sufficient steadite phase to render the ingot hot short.

3. The method of claim 1 wherein the heat treating step b) is conducted between about 1140° to about 1160° C. for a time at temperature of about 9 to about 12 hours.

4. The method of claim 1 wherein the malleable envelope is formed during step b) by heating in an oxidizing environment so as to form a decarburized malleable surface case on the ingot.

5. The method of claim 1 wherein the malleable envelope is formed by depositing a low carbon steel on the ingot.

6. The method of claim 5 wherein the low carbon steel is deposited as a weld bead.

7. The method of claim 1 wherein the malleable envelope is formed by enclosing the ingot in a ductile container.

8. The method of claim 1 wherein the malleable envelope is about 1 to about 20 millimeters in thickness.

9. The method of claim 1 wherein in step d), the ingot is initially shaped about 10° to 300° C. above the $A_{r\text{-}gr}$ temperature.

10. The method of claim 9 wherein the initial shaping temperature is about 30° to about 100° C. above the $A_{r\text{-}gr}$ temperature.

11. The method of claim 1 wherein in step d), the ingot is finally shaped at a temperature about 50° to about 300° C. below the $A_{cm}$ temperature.

12. The method of claim 11 wherein the final shaping temperature is about 100° to about 170° C. below the $A_{cm}$ temperature.

13. A method of making a steel article having a "Damascus" surface pattern and an internal "Damascus" microstructure, comprising the steps of:

a) solidifying a steel melt comprising about 1.0 to about 2.0 weight % carbon, about 0.02 to about 0.4 weight % Mn, about 0.02 to about 0.3 weight % Si, about 0.01 to about 0.04 weight % S and about 0.03 to about 0.15 weight % P, to form an ingot, b) heating the ingot between about 1100° to about 1200° C. for a time at temperature of about 5 to about 12 hours in an oxidizing environment to form a decarburized malleable surface case on the ingot, c) forging the ingot with said surface case thereon initially at an ingot temperature above the $A_{r\text{-}gr}$ temperature but below the liquidus temperature and then at an ingot temperature below the $A_{cm}$ temperature, and d) removing the surface case from the shaped ingot.

* * * * *